United States Patent [19]

Opfer et al.

[11] 4,238,657

[45] Dec. 9, 1980

[54] SWITCH OPERATOR CONDITION AND POSITION INDICATOR MECHANISM

[75] Inventors: John C. Opfer, Deerfield; Edward J. Rogers, Chicago, both of Ill.

[73] Assignee: S&C Electric Company, Chicago, Ill.

[21] Appl. No.: 922,326

[22] Filed: Jul. 6, 1978

[51] Int. Cl.[3] ..... H01H 9/00

[52] U.S. Cl. ..... 200/308

[58] Field of Search ..... 200/308, 309

[56] References Cited

U.S. PATENT DOCUMENTS

| | | | |
|---|---|---|---|
| 1,979,196 | 10/1934 | Guett | 200/308 X |
| 3,024,664 | 3/1962 | Platz | 200/308 X |
| 4,112,278 | 9/1978 | Greiner et al. | 200/156 |
| 4,160,890 | 7/1979 | Chard et al. | 200/308 |

*Primary Examiner*—Steven M. Pollard

*Attorney, Agent, or Firm*—John D. Kaufmann

[57] ABSTRACT

Disclosed is a switch operator condition and position indicator mechanism for high voltage switch operators. The indicator mechanism provides a visual indication of the charged or discharged condition, as well as of the "switch-open" or "switch-closed" position, of the switch operator. Another feature of the indicator mechanism provides a visual indication of whether the high voltage switch being operated by the switch operator is in the open or closed position. The charged or discharged conditions of the switch operator are indicated by labels on a first indicator disk which rotates conjointly with the shaft used to charge the switch operator. The "switch-open" or "switch-closed" positions of the output shaft of the switch operator are indicated by labels on a second indicator disk which is operably connected to the output shaft of the switch operator by means of a linkage assembly which incorporates a spring follower mechanism which reduces the forces exerted on the operator output shaft linkage assembly and the second indicator disk during the operations of the switch operator. The labels on first and second indicator disks corresponding to the condition and position, respectively, of the switch operator are visible through a window in the control panel. The open or closed position of the high voltage switch operated by the switch operator is indicated by a label attached to a switch position lever and a stationary label, respectively, which labels are alternatively visible through another window in the control panel of the switch operator.

14 Claims, 10 Drawing Figures

SWITCH OPERATOR CONDITION AND POSITION INDICATOR MECHANISM

BACKGROUND OF THE INVENTION

1. Field of the Invention

The present invention relates to mechanisms for indicating the condition and position of a switch operator which operates an associated high voltage switch and for indicating the position of the high voltage switch being operated.

2. Description of the Prior Art

Typically in the prior art, the position of manually operated switches could be ascertained visually and externally from the equipment enclosure by the position occupied by the external operating handle which corresponded to the open or closed position of the interrupter switch. However, with respect to switch operators (switch operating mechanisms) of the type described in the pending patent application entitled "HIGH VOLTAGE SWITCH OPERATING MECHANISM", Ser. No. 911,123 filed May 31, 1978, and the pending patent application entitled "SWITCH OPERATOR UNCOUPLING MECHANISM", Ser. No. 911,124 filed May 31, 1978, both of which are assigned to the same assignee as the present invention, there is no unique handle or lever position on the external control panel of the switch operator to indicate by its position the open or closed position of the high voltage switch or the position of the switch operating mechanism or the charged or discharged condition of the switch operating mechansim within the equipment enclosure. A switch operating mechanism of the type described in the above-referenced patent applications can be exercised without changing the position of the high voltage switch, and consequently, the "switch-open" or "switch-closed" position of the switch operating mechanism does not necessarily correspond to the position of the high voltage switch. With switch operators of the type described in the above-referenced patent applications, the switch operator cannot be coupled to the assembly which drives the high voltage switch between the open and closed positions unless the position of the switch operator ("switch open" or "switch closed") corresponds to the position of the high voltage switch ("open" or "closed"). Therefore, after the switch operator has been uncoupled from the high voltage switch by withdrawing it from the equipment enclosure, it may be necessary to operate the switch operator before recoupling to cause the position of its output shaft to correspond to the position of the high voltage switch. Furthermore, with motor-operated switches that can be tripped remotely, it is preferable not to have an external operating handle rapidly change from one position to another in response to the tripping of the high voltage switch.

Therefore, it would be a desirable advance in the art to provide a mechanism for visually indicating, externally to the equipment enclosure, the switch-open or switch-closed position of the high voltage switch as well as the "switch-open" or "switch-closed" position of, and the charged or discharged condition of, the switch operator.

BRIEF DESCRIPTION OF THE INVENTION

An improved switch operator condition and position indicator mechanism for indicating the open or closed position of a high voltage switch and the "switch-open" or "switch-closed" position of, as well as the charged or discharged condition of, the switch operator in accordance with the present invention is comprised of an operator indicator disk assembly and a switch position indicator assembly. The operator indicator disk assembly is comprised of a first indicator disk which rotates conjointly with the main shaft used to charge the switch operator. Since in each of the two extreme positions of the main shaft the switch operator can be either in the charged or discharged condition depending on whether the output shaft of the switch operator is in the "switch-open" or "switch-closed" position, two pairs of charged and discharged labels are attached to the first indicator disk, each pair corresponding to one of the positions of the first indicator disk and the main shaft. In each of the two positions one pair of labels is aligned with a window in the control panel. A second indicator disk is mounted concentrically with the first indicator disk and has a label corresponding to the "switch-closed" position and another corresponding to the "switch-open" position. The second indicator disk also contains first and second windows which align with the labels and a window in the control panel of the switch operator. The labels and windows are positioned such that the switch operator position label corresponding to the position of the output shaft is visible through the window in the control panel and the switch operator condition label corresponding to the switch operator condition is visible through the window in the control panel and one of the windows in the second indicator disk.

The second indicator disk is operably connected to the output shaft of the switch operator by means of a linkage assembly which incorporates a spring follower mechanism. In the spring follower mechanism, the driving and driven members of the switch operator output position linkage assembly are coupled by the ends of a torsion spring. The spring follower mechanism reduces the forces exerted on the operator output position linkage assembly and the second indicator disk during operations of the switch operator when the output shaft of the switch operator rotates very rapidly between the "switch-open" and "switch-closed" positions.

The switch position indicator assembly is comprised of a coupler indicator lever, the position of which corresponds to the position of the high voltage switch being operated by the switch operator, operably connected to a switch position lever. The coupler indicator lever, and consequently the switch position lever, is operably connected to the linkage assembly which operates the high voltage switch and changes position with the high voltage switch. A switch "open" label is mounted to the switch position lever and a switch "closed" label is mounted to the front channel. When the switch is open, the switch position lever is pivoted so that the "open" label is aligned with a window in the control panel of the switch operator and in front of the "closed" label. When the switch is closed, the switch position lever is pivoted out of the way so that the "closed" label is visible through the window.

Thus, it is a primary feature of the present invention to provide an indicator mechanism for a switch operator which indicates visually and externally of the equipment enclosure whether the output shaft of the switch operator corresponds to the "switch-open" or the "switch-closed" position and whether the switch operator is in the charged or discharged condition.

It is also a primary feature of the present invention to provide an indicator mechanism for a switch operator which indicates visually and externally of the equipment enclosure whether the high voltage switch being operated by the switch operator is in the open or closed position, and which provides such indication regardless of whether the switch operator is coupled to or uncoupled from the high voltage switch.

It is another object of the present invention to provide a spring follower mechanism for coupling the output shaft of the switch operator to the indicator mechanism which, by means of a torsion spring, reduces the forces exerted on the output shaft linkage assembly and the indicator mechanism when the output shaft changes positions.

These and other objects, advantages, and features will hereinafter appear, and, for purposes of illustration, but not for limitation, exemplary embodiments of the present invention are illustrated in the accompanying drawings.

DETAILED DESCRIPTION OF THE PREFERRED EMBODIMENT

Figure 1:
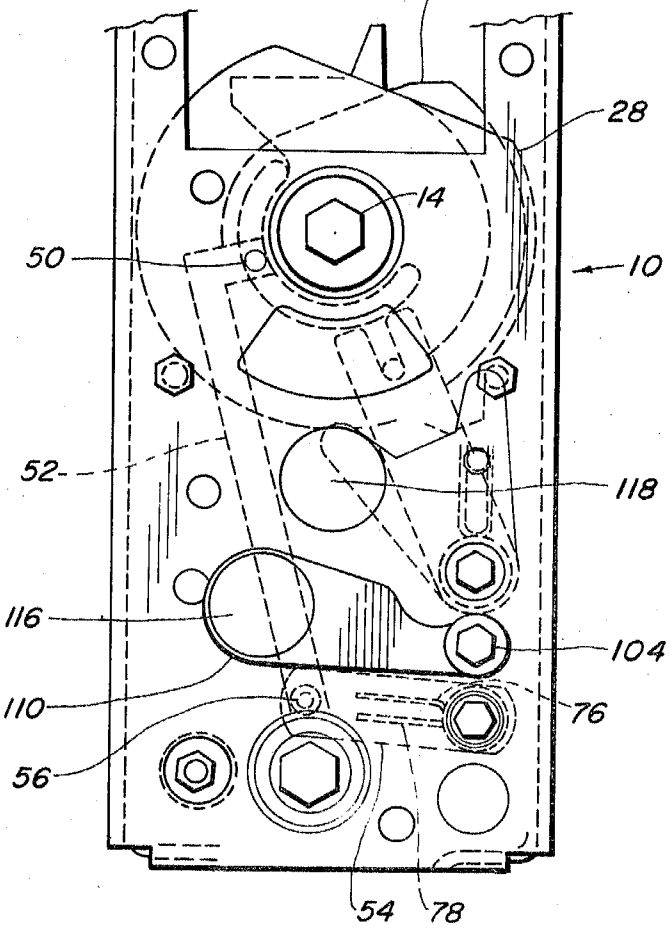
FIG. 1 is front view of the preferred embodiment of the present invention showing the operator indicator disks and the switch position indicator.
Figure 2:
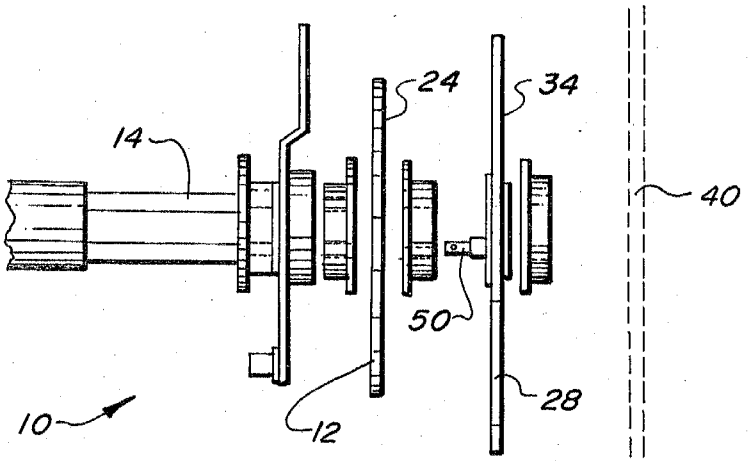
FIG. 2 is a side elevational view of the operator indicator disk assembly of the present invention.
Figure 3:
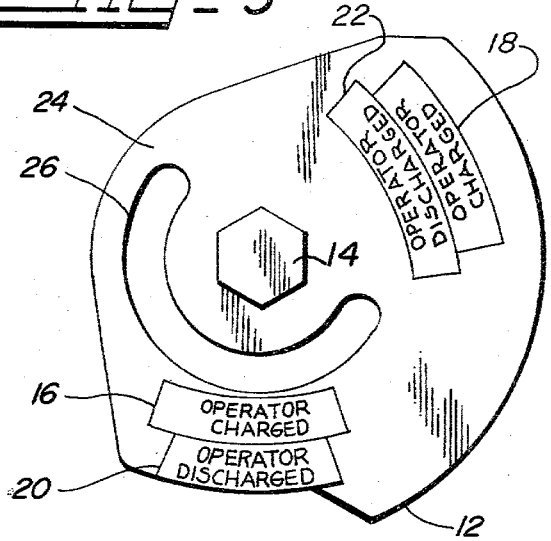
FIG. 3 is a front view of the operator spring positon indicator disk of the present invention.
Figure 4:
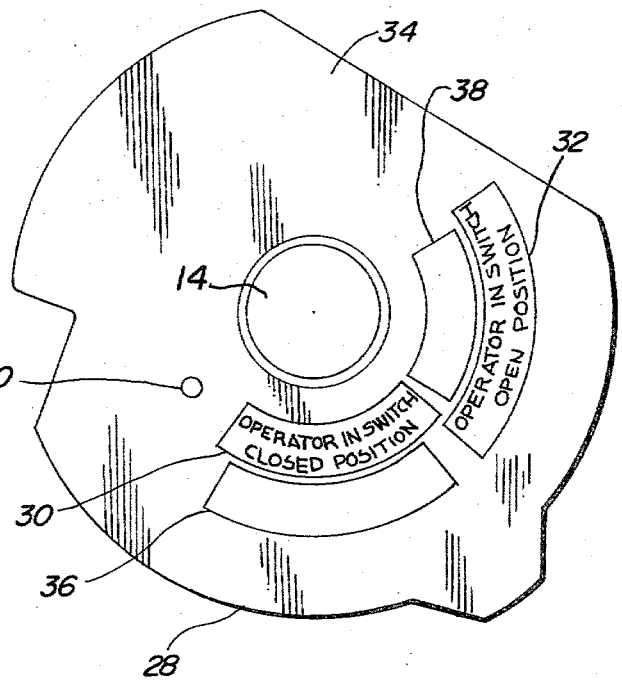
FIG. 4 is a front view of the operator output position indicator disk of the present invention.

With reference to FIGS. 1 and 2, operator indicator disk assembly 10 is shown. First indicator disk 12 (shown in detail in FIG. 3) is mounted on main shaft 14 so that first indicator disk 12 rotates conjointly with main shaft 14. With reference to FIG. 3, first and second "OPERATOR CHARGED" labels 16 and 18 and first and second "OPERATOR DISCHARGED" labels 20 and 22 are suitably mounted on surface 24 of first indicator disk 12. Second indicator disk 28 (shown in detail in FIG. 4) is suitably mounted on main shaft 14 so that second indicator disk 28 rotates freely and concentrically with respect to main shaft 14 and first indicator disk 12. With reference to FIG. 4, "OPERATOR IN SWITCH CLOSED POSITION" label 30 and "OPERATOR IN SWITCH OPEN POSITION" label 32 are suitably attached to surface 34 of second indicator disk 28. Second indicator disk 28 also has first and second windows 36 and 38, the function of which will be described below. Although described as labels in the detailed description of the present invention, it should be expressly understood that labels 16, 18, 20 and 22 on first indicator disk 12, and labels 20 and 22 on second indicator disk 28, also could be any suitable type of indicia other than labels. Similarly, it should also be expressly understood that the words "OPERATOR CHARGED", "OPERATOR DISCHARGED", "OPERATOR IN SWITCH CLOSED POSITION", and "OPERATOR IN SWITCH OPEN POSITION" need not be used. Thus, other words, symbols, markings, color schemes, etchings, etc. or combinations of these could be used on or in connection with first and second indicator disks 12 and 28 instead of the labels containing the words as described above to indicate the position and condition of the switch operator without departing from the spirit and scope of the present invention. It should also be expressly understood that first and second indicator disks 12 and 28 may take other forms in addition to those illustrated in the accompanying drawings. Thus, such forms as, for example, flags, rectangular plates, or plates of other shapes would also be suitable for first and second indicator disks 12 and 28.

Labels 30 and 32 on second indicator disk 28 are visible through operator position window 42 (shown in FIG. 8) in control panel 40 when the switch operator is in the "switch-closed" and "switch-open" positions, respectively, as is further explained below. Either first OPERATOR DISCHARGED LABEL 20 or second OPERATOR CHARGED label 18 is visible through window 42 in control panel 40 and first window 36 in second indicator disk 28, depending upon the position of first indicator disk 12 as is further explained below. Either first OPERATOR CHARGED label 16 or second OPERATOR DISCHARGED label 22 is visible through window 42 in control panel 40 and second window 38 in second indicator disk 28, depending upon the position of first indicator disk 12 as is further explained below.

First indicator disk 12 rotates conjointly with main shaft 14, which rotates clockwise (as viewed from the front in FIG. 1) to charge the switch operating mechanism for a switch-opening operation and which rotates counterclockwise (as viewed from the front in FIG. 1) to charge the switch operating mechanism for a switch-closing operation.

Figure 5:
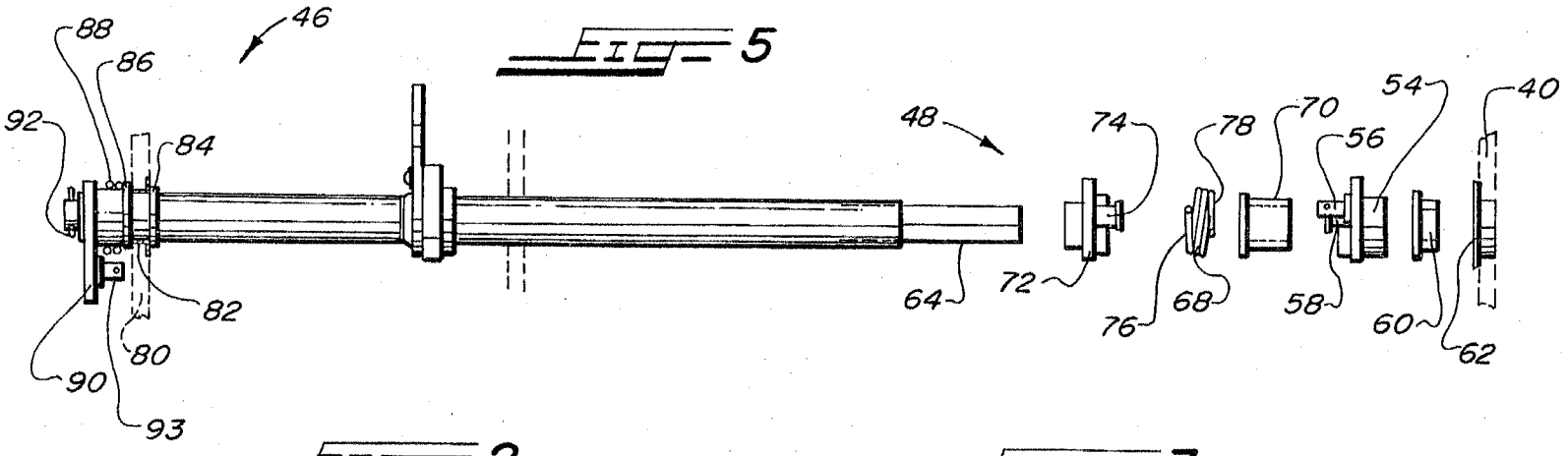
FIG. 5 is a side elevational, exploded view of the operator output position linkage assembly of the present invention.

With reference to FIGS. 1, 2 and 5, pin 50 is rigidly secured to second indicator disk 28. One end of linkage member 52 is pivotably fastened to second indicator disk 28 by pin 50. The other end of linkage member 52 is pivotably fastened to lever 54 by pin 56, which is suitably secured to lever 54. Lever 54 is supported in control panel 40 by bearing 60 and bushing 62 so that lever 54 rotates freely with respect to control panel 40. Linkage drive spring 68 is rotatably mounted on bushing 70 so that is rotates coaxially with shaft 64. Drive lever 72 is suitably mounted on shaft 64 so that drive lever 72 rotates conjointly with shaft 64. Driven spring pin 58 is rigidly mounted on lever 54 and driving spring pin 74 is rigidly mounted on drive lever 72 so that driven spring pin 58 and driving spring pin 74 align between first and second legs 76 and 78 of linkage drive spring 68. First and second legs 76 and 78 are biased towards each other so that when shaft 64 is at rest driven spring 58 and driving spring pin 74 are held in alignment.

Figure 6:
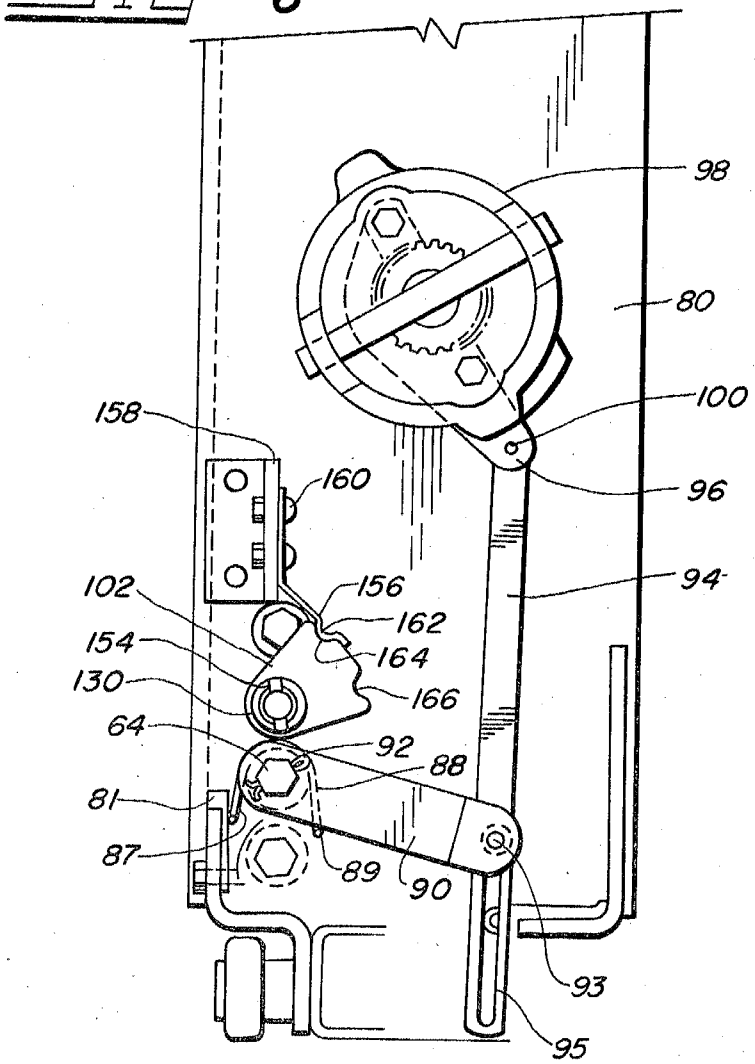
FIG. 6 is a rear view of operator output position linkage assembly and of the switch position indicator coupling of the present invention.

With reference to FIGS. 5 and 6, output shaft linkage assembly 46 which operably connects shaft 64 to output coupling 98 of the switch operator is shown. Lever 90 is rigidly attached to the end of shaft 64 opposite from drive lever 72 so that lever 90, shaft 64, and drive lever 72 rotate conjointly. Shaft 64 is supported in rear channel 80 by bushing 82 and bearing 84 so that shaft 64 rotates freely in rear channel 80. Lever 90 is spaced from rear channel 80 by washer 86 and spring 88 and is prevented from sliding off the end of shaft 64 by cotter pin 92. First end 87 of spring 88 is rigidly attached to bracket 81 which is rigidly mounted on rear channel 80. Second end 89 of spring 88 is hooked over the lower edge of lever 90 and rigidly attached. Thus, spring 88 provides bias against lever 90 so that spring 88 tends to pivot lever 90 counterclockwise as viewed in FIG. 6 when link 94 is in the "switch-closed" position. When lever 90 is pivoted counterclockwise sufficiently far, spring 88 provides a bias on lever 90 tending to pivot lever 90 in the counterclockwise direction as viewed in FIG. 6. Pin 93 is rigidly fastened to the other end of lever 90 and provides the means for pivotably connecting lever 90 to link 94. The other end of link 94 is pivotably connected to member 96 of output coupling 98 by pin 100. Output coupling 98 rotates between two positions corresponding to the "switch-open" or "switch-closed" positions of the switch operator. In FIG. 6, the position of output coupling 98 is shown when the switch operator is in the "switch-closed" position. Pin 93 extends through slot 95 in link 94 and, due to the bias provided by spring 88, engages the upper end of slot 95 when link 94 is in the "switch-closed" position as shown in FIG. 6. When link 94 is in the "switch-open" position, output coupling 98 is rotated counterclockwise approximately 120 degrees from the position shown in FIG. 6. In the "switch-open" position, link 94 is raised so that pin 93 engages the lower end of slot 95. Lever 90 is thus pivoted counterclockwise by engagement of pin 93 with the lower end of slot 95. Since the distance traveled by link 94 in moving between the "switch-open" and "switch closed" positions is greater than the length of slot 95, one end of slot 95 engages pin 93 for a portion of the distance traveled either up or down and thereby causes lever 90 to pivot either counterclockwise or clockwise, respectively. Slot 95 thereby serves to limit the distance through which lever 90 and shaft 64 are caused to pivot by the change in position of link 94 when the switch operator changes from the "switch-open" to "switch-closed" position or from the "switch-closed" to the "switch-open" position. The length of slot 95 is appropriately chosen so that the rotation of shaft 64 caused by an operation of the switch operator will cause second indicator disk 28 to rotate the proper amount to align the appropriate label 30 or 32 with operator position window 42.

With reference to FIGS. 1, 5, and 6, spring follower assembly 48 which operably connects shaft 64 of output linkage assembly 46 to second indicator disk 28 is shown. When shaft 64 rotates, drive lever 72 is pivoted conjointly with shaft 64. Thus, when the switch operator changes from the "switch-closed" position, shown in FIG. 6, to the "switch-open" position, shaft 64 rotates counterclockwise as viewed in FIG. 6, which is clockwise as viewed in FIG. 1. This rotation of shaft 64 causes driving spring pin 74 on drive lever 72 to engage first leg 76 of linkage drive spring 68. Driving spring pin 74 thereby rotates linkage drive spring 68 causing second leg 78 of linkage drive spring 68 to engage driven spring pin 58 of lever 54. Thus, lever 54 is caused to pivot in the same direction as shaft 64 by first and second legs 76 and 78 of linkage drive spring 68. Since, first and second legs 76 and 78 can spread apart by overcoming the bias of linkage drive spring 68, during fast operating conditions driven spring pin 58 lags behind driving spring pin 74. Thus, in spring follower assembly 48 the bias provided by opposed first and second legs 76 and 78 of linkage drive spring 68, which is a torsion spring, tends to bring driving spring pin 74 and driven spring pin 58 together, but in which the force delivered to driven spring pin 58 and, consequently, to second indicator disk 28 through lever 54 and linkage member 52 is limited to the force which can be exerted by first and second legs 76 and 78 of linkage drive spring 68. Thus, spring follower assembly 48 for driving second indicator disk 28 decreases the forces exerted on lever 54, linkage member 52, and second indicator disk 28 from what would be exerted if second indicator disk 28 was coupled directly to output coupling 98 of the switch operator.

Figure 7:
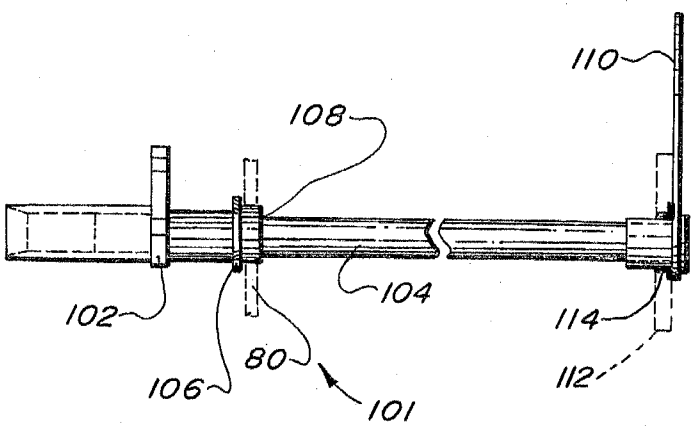
FIG. 7 is a side elevational view of the switch position indicator assembly of the present invention.
Figure 9:
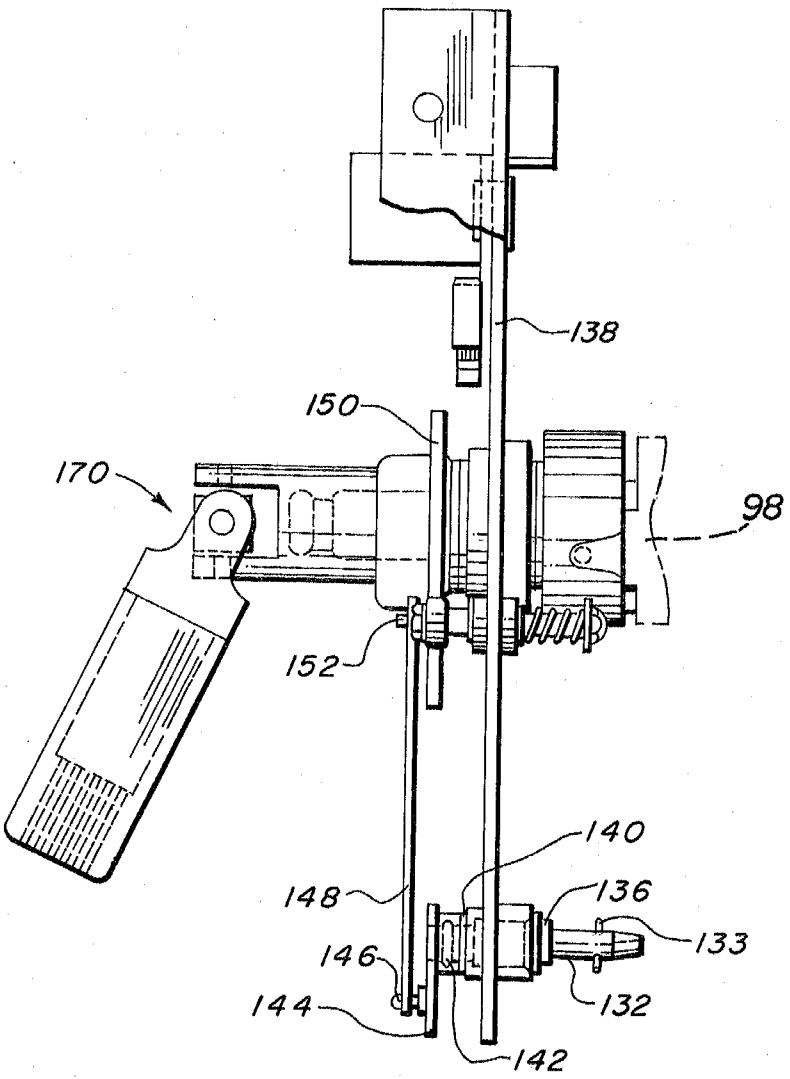
FIG. 9 is a partially fragmentary side elevational view showing a portion of the coupling mechanism between the high voltage switch and the switch position indicator assembly of the present invention.
Figure 10:
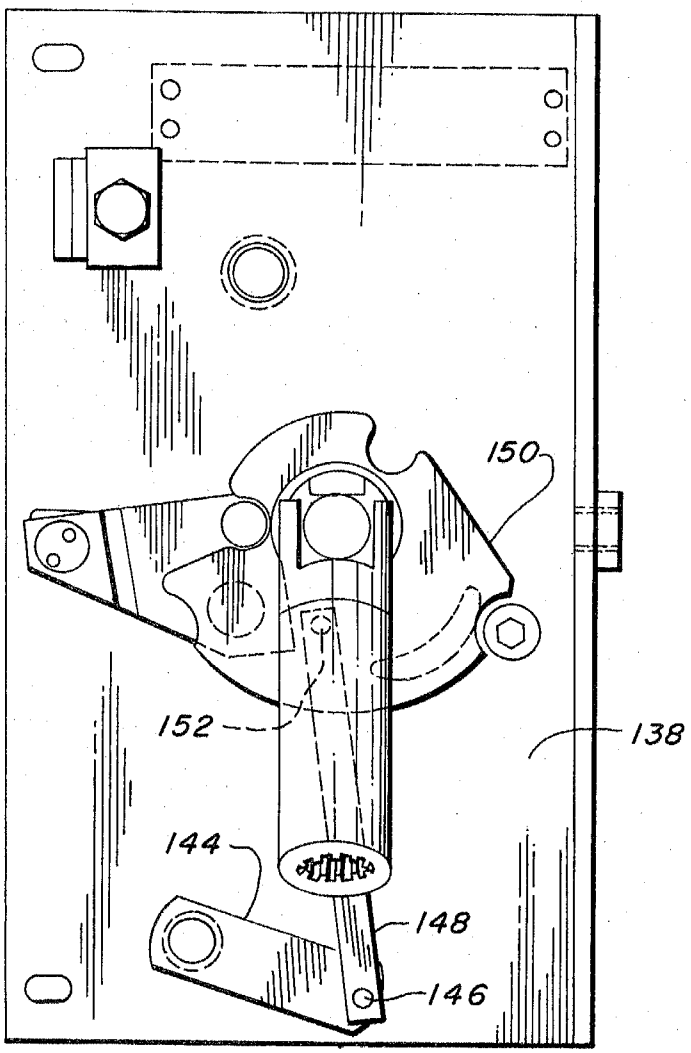
FIG. 10 is a rear view of the coupling mechanism shown in FIG. 9.

With reference to FIGS. 6 and 7, switch position indicator assembly 101 of the present invention is operably connected to indicator coupling 130, the position of which corresponds to the position of the high voltage switch (not shown) being operated by the switch operator. Indicator coupling 130 is related to the coupling mechanism described in the co-pending patent application entitled "SWITCH OPERATOR UNCOUPLING MECHANISM," Ser. No. 911,124 filed May 31, 1978, which is assigned to the same assignee as the present invention. With reference to FIGS. 6, 9, and 10, indicator coupling 130, which is pivotably mounted to rear channel 80, engages stub shaft 132 and pin 133 when output coupling 98 is in the position corresponding to the position of the high voltage switch (not shown) being operated and the switch operator is fully inserted in the equipment enclosure (not shown) as described in the above-referenced patent application. Stub shaft 132 is journaled in bushing 136 which is carried by support plate 138. Support plate 138 is rigidly mounted to the equipment enclosure (not shown). Hollow shaft 140 slides over the end of stub shaft 132 and is secured by pin 142 so that hollow shaft 140 and stub shaft 132 rotate conjointly. The other end of hollow shaft 140 is rigidly mounted to first lever 144 so that first lever 144 pivots conjointly with shaft 140. Thus, when first lever 144 pivots, stub shaft 132 is caused to rotate also. The end of first lever 144 opposite from hollow shaft 140 is pivotably connected by pin 146 to second lever 148. The other end of second lever 148 is pivotably connected to interlock disk 150 by pin 152. Thus, when interlock disk 150 rotates from one of its two positions to the other, second lever 148 causes first lever 144 to pivot up or down, which causes stub shaft 132 to rotate between two corresponding angular positions. Interference between pin 133 in stub shaft 132 and indicator coupling 130 prevents the switch operator from being fully inserted into the equipment enclosure (not shown) unless the switch operator is set to the correct position; i.e., the position corresponding to whether the high voltage switch (not shown) being operated by the switch operator is either open or closed. This is because interlock disk 150 rotates whenever the high voltage switch changes position and only when the high voltage switch changes position, as described in the above-referenced patent application. Thus, the position of interlock disk 150, and the angular position of stub shaft 132 and pin 133, is determined by the position of the high voltage switch. With reference to FIGS. 6 and 9, indicator coupling 130 cannot engage stub shaft 132 and slide over pin 133 unless indicator coupling 130 is rotated so that slot 154 (see FIG. 6) in indicator coupling 130 aligns with pin 133. It should be understood that other suitable alignment means besides pin 133 could also be used to prevent coupling of the switch operator except when the position of the switch operator uniquely corresponds to the position of the high voltage switch.

Indicator coupling 130 is suitably secured to coupler indicator lever 102 so that coupler indicator lever 102 rotates conjointly with indicator coupler 130. Leaf spring 156 is secured to bracket 158 as by bolts 160, and bracket 158 is suitably secured to rear channel 80 of the switch operator, thereby providing a rigid mounting for leaf spring 156. Detent 162 engages either first notch 164 or second notch 166 in coupler indicator lever 102, depending upon the angular position of coupler indicator lever 102. The bias provided by leaf spring 156 prevents random movements or vibration of the switch operator from causing coupler indicator lever 102 to change position. However, an actual switch operation causes rotation of stub shaft 132 and pin 133 with sufficient torque to overcome the bias of leaf spring 156 and to rotate indicator coupling 130 and coupler indicator lever 102. Thus, since only actual operations of the high voltage switch being operated cause coupler indicator lever 102 to change position, the position of coupler indicator lever 102 corresponds to the open or closed position of the high voltage switch being operated by the switch operator.

With reference to FIGS. 1, 6, and 7, switch position indicator assembly 101 of the present invention is disclosed. Coupler indicator lever 102 is rigidly mounted on shaft 104 so that indicator coupling lever 102 and shaft 104 rotate conjointly. Shaft 104 is supported in rear channel 80 by bushing 106 and bearing 108 so that shaft 104 rotates freely in rear channel 80. On the other end of shaft 104 is mounted switch position lever 110, which is supported in front channel 112 by bushing 114 so that switch position lever 110 rotates freely with respect to front channel 112. "SWITCH OPEN" label 116 is suitably secured to switch position lever 110, and "SWITCH CLOSED" label 118 is suitably secured to front channel 112. "SWITCH CLOSED" label 118 is positioned on front channel 112 so that it is aligned with switch position window 44 in control panel 40.

When the switch operated by the switch operator is in the closed position, indicator coupling lever 102, shaft 104, and switch position lever 110 are pivoted so that "SWITCH CLOSED" label 118 is visible through switch position window 44 in control panel 40. FIG. 1 shows the position of switch position lever 110 when the switch operated by the switch operator is in the closed position.

When the switch operated by the switch operator is in the open position, indicator coupling lever 102, shaft 104, and switch position lever 110 are pivoted so that "SWITCH OPEN" label 116 is aligned in front of "SWITCH CLOSED" label 118. Therefore, when the switch is open "SWITCH OPEN" label 118 is visible through switch position window 44 in control panel 40.

A switch operator of the type for which the present invention is intended to be used can be uncoupled from the high voltage switch and withdrawn by a human operator partially or completely from the equipment enclosure and operated or exercised. That is, the switch operator can be charged and discharged, thereby changing the position of the switch operator without affecting the position of the high voltage switch. In order for the human operator to re-insert the switch operator into the enclosure so that it is again coupled to the high voltage switch, it is necessary for the position of the switch operator to correspond to the position of the high voltage switch. Reinsertion and coupling of the switch operator is facilitated by the combination of the switch operator position indicator feature and the switch position indicator feature of the present invention. Thus, by observing the position of the switch operator as indicated by the label visible through operator position window 42 and the position of the high voltage switch as indicated by the label visible through switch position window 44, a human operator can ascertain whether the position of the switch operator corresponds to the position of the high voltage switch when the switch operator is in the uncoupled position. If the positions do not correspond, the human operator can operate the switch operator to make the positions correspond, as they must in order to couple the switch operator again, before attempting to insert the switch operator back into the coupled position.

It should be expressly understood that various modifications and changes can be made to the structure of the present invention as illustrated herein without departing from the spirit and scope of the present invention as defined in the appended claims.

Figure 8:
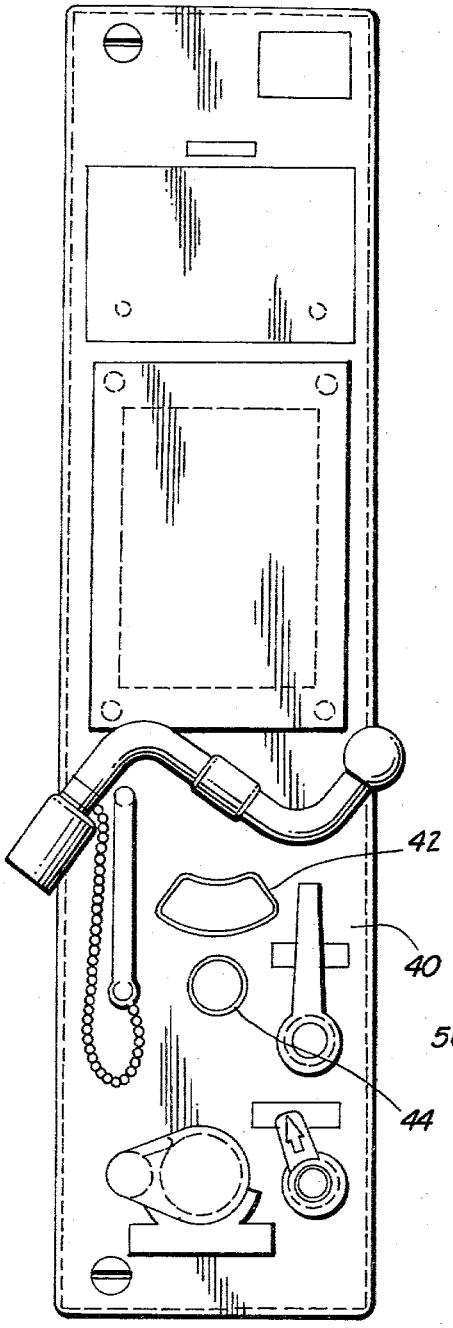
FIG. 8 is a front view of the control panel of the present invention showing the switch position panel window and the operator position panel window.

In summary, and referring to FIGS. 1, 3, 4 and 8:

(a) The switch position lever 110 has the position shown in FIG. 1 if the switch is closed; the label 118 is visible through the window 44 (FIG. 8). If the switch is open, the lever 110 rotates clockwise so that the label 118 is covered thereby and only the label 116 is visible through the window 44 (FIG. 8).

(b) The first indicator disk 12 assumes the position shown in FIG. 3, whereat the labels 16 and 20 are aligned with the window 42, as the operator is charged to close the switch by counterclockwise rotation of the main shaft 14. The first disk 12 and the labels 16 and 20 retain the position of FIG. 3 following closing of the switch by clockwise rotation of the main shaft 14. If the main shaft 14 is rotated clockwise to charge the operator to open the switch, the first disk 12 rotates clockwise to position the labels 18 and 22 in alignment with the window 42.

(c) The second indicator disk 28 assumes the position of FIG. 4 whereat the labels 30 and the window 36 are aligned with the window 42 if the output coupling 98 of the operator is in the switch-closed position. If the output coupling 98 assumes the switch-open position, the second disk 28 rotates clockwise to align the label 32 and the window 38 with the window 42.

If the operator and the switch are properly coupled, the output coupling 98 engages a switch drive assembly 170 (FIG. 9) and the indicating coupling 130 is coupled to the stub shaft 132. Accordingly, the following indications are given:

(1) Switch closed, output coupling 98 in switch closed position, operator not charged to open switch—label 118 visible through window 44; label 30 and window 36 visible through window 42; label 20 visible through windows 36 and 42. Indications given are "switch closed," "operator in switch-closed position," and "operator discharged."

(2) Same as (1) but operator has been charged to open switch—label 118 visible through window 44; label 30 and window 36 visible through window 42; label 18 visible through windows 36 and 42. Indications given are "switch closed," "operator in switch-closed position," and "operated charged."

(3) Switch open, output coupling 98 in switch-open position, operator not charged to close switch—label 116 visible through window 44; label 32 and window 38 visible through window 42; label 22 visible through windows 38 and 42. Indications given are "switch open," "operator in switch-open position," and "operator discharged."

(4) Same as (3), but operator has been charged to close switch—label 116 visible through window 44; label 32 and window 38 visible through window 44; label 16 visible through windows 38 and 42. Indications given are "switch open," "operator in switch-open position," and "operated charged."

If the operator and the switch are not coupled, it is possible for the switch and the output coupling 98 to not have complementary positions. For example, after decoupling the operator from the switch, the operator may be exercised so that the output coupling 98 is in the switch-closed position (the operator may or may not be charged to move the coupling 98 to the switch-open position), while the switch, however, is open. As noted above, the output coupling 98 and the switch drive assembly 170, on the one hand, and the coupling 130 and the stub shaft 132 on the other hand must be in complementary positions to recouple the operator and the switch. Such complementary positions obtain if the label 116 or 118 viewed through the window 44 is complementary to the label 30 or 32 viewed through the window 42. The two complementary indications are "switch closed" (label 118) and "operator in switch-closed position" (label 30), or "switch open" (label 116) and "operator in switch-open position" (label 32). Note that if the operator and the switch are decoupled, the label 116 or 118 visible through the window 44 cannot change because the coupling 130 is decoupled from the stub shaft 132, the position of which depends solely on the position of the switch and of its drive assembly 170. When the output coupling 98 is decoupled from the drive assembly 170, movement of the coupling 98 cannot affect the assembly 170 or the position of the switch position lever 110.

We claim:

1. An indicator mechanism for indicating the condition and position of a switch operator, the operator having (a) an output shaft rotatable between a switch-closed and a switch-open position and (b) an input shaft rotatable between a first position, whereat selectively releasable energy for rotating the output shaft to the switch-closed position is stored in the operator, and a second position, whereat selectively releasable energy for rotating the output shaft to the switch-open position is stored in the operator, the switch being opened or closed by rotation of the output shaft if the output shaft is coupled to the switch, the switch being unaffected by rotation of the output shaft if the output shaft is not coupled to the switch, the indicator mechanism comprising:

a first indicator connected to the input shaft of the switch operator for conjoint rotation with the input shaft between a position corresponding to the charged-to-open condition of the switch operator and a position corresponding to the charged-to-closed condition of the switch operator, said first indicator having visible indicia thereon for indicating the condition of the switch operator depending upon the position of the first indicator; and a second indicator connected to the output shaft of the switch operator for rotation to a first position when the switch operator is in the switch-closed position and to a second position when the switch operator is in the switch-open position, said second indicator having visible indicia thereon for indicating whether the switch operator is in the switch-closed or switch-open position depending upon the position of the second indicator, all indicia being simultaneously visible to indicate the condition and position of the switch operator.

2. An indicator mechanism for indicating the condition and position of a switch operator comprising:

first indicator means connected to an input shaft of the switch operator for conjoint rotation with the input shaft between a position corresponding to a charged-to-open condition of the switch operator and a position corresponding to a charged-to-close condition of the switch operator;

first indicia means on said first indicator means for indicating that the switch operator is charged or discharged, depending upon the condition of the switch operator;

second indicator means mounted coaxially with said first indicator means for relative rotation with respect thereto;

first and second apertures in said second indicator means positioned so that said first and second apertures align with said first indicia means on said first indicator means;

second indicia means mounted on said second indicator means for indicating that the switch operator is in a "switch-closed" position or a "switch-open" position, depending upon the position of the switch operator;

linkage means connected between said second indicator means and an output shaft of the switch operator for rotating said indicator means to a first position when the switch operator is in the "switch-closed" position and to a second position when the switch operator is in the "switch-open" position; and a member having a window, the window being located so that (a) when the switch operator is in the "switch-closed" position and said second indicator means is in the first position, said second indicia means is visible through said window and indicates that the switch operator is in the "switch-closed" position, and, depending upon whether the switch operator is in the charged or discharged condition, said first indicia means visible through said window and said first aperture in said second indicator means to indicate whether the switch operator is in the charged or discharged conditions, and (b) when the switch operator is in the "switch-open" position and said second indicator means is in the second position, said second indicia means is visible through said window and indicates that the switch operator is in the "switch-open" position, and, depending upon whether the switch operator is in the charged or discharged condition, said first indicia means is visible through said window and said second aperture in said second indicator means to indicate whether the switch operator is in the charged or discharged condition.

3. An indicator mechanism, as claimed in claim 2, wherein said first indicia means further comprises:

first and second pairs of labels suitably mounted on said first indicator means for indicating whether the switch operator is in the charged or discharged condition.

4. An indicator mechanism, as claimed in claim 2, wherein said second indicia means further comprises:

first and second labels suitably mounted on said second indicator means for indicating whether the switch operator is in the "switch-closed" or "switch-open" position.

5. An indicator mechanism, as claimed in claim 2, wherein said linkage means further comprises:

a shaft connected to the output shaft of the switch operator for rotation therewith;

a drive lever rigidly mounted on said shaft so that said drive lever and said shaft rotate conjointly;

a torsion spring freely mounted on said shaft and having first and second ends which extend outward from the spring and which are biased towards each other;

a driving spring pin rigidly mounted to said drive lever in a position between the first and second ends of said torsion spring for engaging the first end of said torsion spring when said shaft and said drive lever rotate in a first direction and for engaging the second end of said torsion spring when said shaft and said drive lever rotate in a second direction;

a driven lever freely mounted on said shaft;

a driven spring pin rigidly mounted to said driven lever for engagement by the second end of said torsion spring when said driving spring pin is rotated to engage the first end of said torsion spring, and for engagement by the first end of said torsion spring when said driving spring pin thereby being rotated by the first or second end of said torsion spring when said driving spring pin engages the second or first end, respectively, of said torsion spring, rotation of said driven spring pin lagging rotation of said driving spring pin until the bias between the ends of said torsion spring rotates said driven spring pin; and a linkage member, one end of which is pivotably mounted to said driven lever, the other end of which is pivotably mounted to said second indicator means thereby causing said second indicator means to rotate to the first position when the output shaft of the switch operator is rotated to the "switch-closed" position and to rotate to a second position when the output shaft of the switch operator is rotated to the "switch-open" position.

6. An indicator mechanism, as claimed in claim 5, further comprising:

an output shaft member rigidly mounted to the output shaft of the switch operator such that said output shaft member and the output shaft rotate conjointly;

a link member having an elongated slot, said link member being pivotably connected to said output shaft member thereby causing said link member to move between two positions as the output shaft of the switch operator rotates between the "switch-open" and "switch-closed" positions;

a lever, one end of said lever being rigidly mounted to the end of said shaft opposite from said drive lever so that said lever pivots conjointly with said shaft, the other end of said lever being slidably connected to and carried by the slot in said link member; and a spring surrounding said shaft adjacent said lever, said spring biasing said lever to a neutral position thereby causing said lever to engage the first end of the slot in said link member when the output shaft of the switch operator rotates to the "switch-closed" position and thereby moves said link member to a first position and causing said lever to engage the second end of the slot in said link member when the output shaft of the switch operator rotates to the "switch-open" position and thereby moves said link member to a second position.

7. An indicator mechanism for indicating the condition and position of a switch operator comprising:

first disk means for conjointly rotating with an input shaft of the switch operator between a position corresponding to the charged-to-open condition of the switch operator and a position corresponding to the charged-to-close condition of the switch operator;

first and second pairs of OPERATOR CHARGED and OPERATOR DISCHARGED labels attached to said first disk means;

second disk means mounted coaxially with said first disk means for relative rotation with respect thereto;

a first aperture in said second disk means positioned to align with the OPERATOR CHARGED label from said first pair of labels on said first disk means and the OPERATOR DISCHARGED label from said second pair of labels on said first disk means, depending on whether this input shaft of the switch operator and said first disk means are rotated to the position corresponding to the charged-to-open condition of the switch operator or to the position corresponding to the charged-to-close condition of the switch operator;

a second aperture in said second disk means positioned to align with the OPERATOR DISCHARGED label from said first pair of labels on said first disk means and the OPERATOR CHARGED label from said second pair of labels on said first disk means, depending on whether the input shaft of the switch operator and said first disk means are rotated to the position corresponding to the charged-to-open condition of the switch operator or to the position corresponding to the charged-to-close condition of the switch operator;

an OPERATOR IN SWITCH CLOSED POSITION label mounted on said second disk means and associated with said first aperture;

an OPERATOR IN SWITCH OPEN POSITION label mounted on said second disk means and associated with said second aperture;

linkage means for conjointly rotating the second disk means with an output shaft of the switch operator between a first position when the switch operator is in the "switch-closed" position and a second position when the switch operator is in the "switch-open" position;

an aperture in a control panel of the switch operator whereby, when the switch operator is in the "switch-closed" position so that said second disk means is in the first position, said OPERATOR IN SWITCH CLOSED POSITION label on said second disk means is visible through said aperture and, depending upon whether the switch operator is in the charged or discharged condition, either the OPERATOR DISCHARGED label from said first pair of labels on said first disk means or the OPERATOR CHARGED label from said second pair of labels on said first disk means is also visible through said aperture in the control panel and said first aperture in said second disk means, and whereby, when the switch operator is in the "switch-open" position so that said second disk means is in the second position, said OPERATOR IN SWITCH OPEN POSITION label on said second disk means is visible through said aperture and, depending upon whether the switch operator is in the charged or discharged condition, either the OPERATOR CHARGED label from said first pair of labels on said first disk means or the OPERATOR DISCHARGED label from said second pair of labels on said first disk means is also visible through said aperture in the control panel and said second aperture in said second disk means.

8. An indicator mechanism for indicating the position of a high voltage switch operated by a switch operator which is selectively coupleable to or decoupleable from the switch comprising:

(a) on the switch interlock disk means on the high voltage switch for assuming a position which corresponds to the open or closed position of the high voltage switch; and first connecting means connected to said interlock means for movement therewith and containing first alignment means; and (b) on the operator second connecting means containing second alignment means for engaging the first alignment means when said second connecting means assumes a unique position corresponding to the position of said first connecting means, said second connecting means preventing engagement with said first connecting means when said second connecting means is not in the unique position corresponding to the position of said first connecting means;

a coupler indicator lever connected to said second connecting means for movement therewith and having first and second notches;

leaf spring means for engaging the first or second notches in said coupler indicator lever, depending upon the position thereof, and for thereby providing a spring bias to inhibit rotation of said coupler indicator lever; and a switch position indicator means connected to said coupler indicator lever for providing an indication corresponding to the position of the high voltage switch.

9. An indicator mechanism, as claimed in claim 8, wherein said switch position indicator means comprises:

a shaft, one end of said shaft moving with said coupler indicator lever;

an aperture;

a SWITCH CLOSED label aligned with said aperture; and a switch position lever rigidly mounted on the other end of said shaft and having a SWITCH OPEN label mounted on its side, said switch position lever being positioned so that, when said coupler indicator lever is in the position corresponding to the open position of the high voltage switch, said switch position lever is pivoted to the position covering the SWITCH CLOSED label and in which the SWITCH OPEN label is aligned with and visible through said aperture, and, when said coupler indicator lever is in the position corresponding to the closed position of the high voltage switch, said switch position lever is pivoted to a second position in which said SWITCH CLOSED label is visible through said aperture.

10. An indicator mechanism for indicating the condition and position of a switch operator comprising:

a first disk connected to an input shaft of the switch operator so that said first disk rotates conjointly with the input shaft between a position corresponding to the charged-to-open condition of the switch operator and a position corresponding to the charged-to-close condition of the switch operator;

first and second pairs of OPERATOR CHARGED AND OPERATOR DISCHARGED labels attached to said first disk;

a second disk rotatably mounted coaxially with said first disk;

a first aperture in said second disk positioned so that it aligns with the OPERATOR CHARGED label from said first pair of labels on said first disk and the OPERATOR DISCHARGED label from said second pair of labels on said first disk, depending on whether the input shaft of the switch operator and said first disk are rotated to the position corresponding to the charged-to-open condition of the switch operator or to the position corresponding to the charged-to-close condition of the switch operator;

a second aperture in said second disk positioned so that it aligns with the OPERATOR DISCHARGED label from said first pair of labels on said first disk and the OPERATOR CHARGED label from said second pair of labels on said first disk, depending on whether the input shaft of the switch operator and said first disk are rotated to the position corresponding to the charged-to-open condition of the switch operator or to the position corresponding to the charged-to-open condition of the switch operator;

an OPERATOR IN SWITCH CLOSED POSITION label mounted on said second disk and associated with said first aperture;

an OPERATOR IN SWITCH OPEN POSITION label mounted on said second disk and associated with said second aperture;

a linkage assembly for rotating said second disk with an output shaft of the switch operator to a first position when the switch operator is in the "switch-closed" position and to a second position when the switch operator is in the "switch-open" position;

an aperture in a control panel of the switch operator whereby, when the switch operator is in the "switch-closed" position so that said second disk is in the first position, said OPERATOR IN SWITCH CLOSED POSITION label on said second disk is visible through said aperture and, depending upon whether the switch operator is in the charged or discharged condition, either the OPERATOR DISCHARGED label from said first pair of labels on said first disk or the OPERA- TOR CHARGED label from said second pair of labels on said first disk is also visible through said aperture in the control panel and said second aperture in said second disk, and whereby, when the switch operator is in the "switch-open" position so that said second disk is in the second position, said OPERATOR IN SWITCH OPEN POSITION label on said second disk is visible through said aperture and, depending upon whether the switch operator is in the charged or discharged condition, either the OPERATOR CHARGED label from said first pair of labels on said first disk or the OPERATOR DISCHARGED label from said second pair of labels on said first disk is also visible through said aperture in the control panel and said second aperture in said second disk.

11. An indicating mechanism for a stored-energy operator for a switch, the operator having (a) an output member movable between a switch-closed position and a switch-open position, (b) means for selectively coupling the output member to the switch so that the switch is opened or closed upon movement of the output member and for selectively decoupling the output member from the switch so that the switch is unaffected by movement of the output member, and (c) an input member movable between a first position, whereat selectively releasable energy for moving the output member to the switch-closed position is stored in the operator and a second position whereat selectively releasable energy for moving the output member to the switch-open position is stored in the operator; the indicating mechanism comprising:

first two-position indicating means for occupying a first position or a second position when the input member is in its respective first or second position;

first visible indicia means for denoting the significance of the position of the first indicating means;

second two-position indicating means for occupying a first position or a second position when the output member is in its respective first or second position; and second visible indicia means for denoting the significance of the position of the second indicating means, the first and second indicia means being simultaneously visible to permit simultaneous determination of the position of the output and input members and, therefore, the condition of the operator.

12. An indicating mechanism as set forth in claim 11 which further comprises:

third two-position indicating means for occupying a first position or a second position respectively corresponding to the extant closed or open condition of the switch whether or not the operator and the switch are coupled by the coupling means; and third visible indicia means for denoting the significance of the position of the third indicating means, all of the indicia means being simultaneously visible to permit simultaneous determination of both the extant condition of the operator and the extant condition of the switch whether or not the operator and the switch are coupled.

13. An indicating mechanism as set forth in claim 11 wherein the switch and the switch operator may be selectively coupled or decoupled only when the output member and the switch reside in complementary positions, the indicating mechanism further comprising:

third two-position indicating means for occupying a first position or a second position when the switch is closed or open and the switch and the switch operator are coupled, and, for occupying a first position or a second position depending upon whether the switch is closed or open at the time the operator and the switch are decoupled;

third visible indicia means for denoting the significance of the position of the third indicating means, all of the indicia means being simultaneously visible to permit simultaneous determination of the condition of the operator and of either the condition of the switch, if the operator and the switch are coupled, or, the condition of the switch at the time the operator and the switch are decoupled.

14. The indicating mechanism of claim 11, 12, or 13 wherein:

the first two-position indicating means and the first visible indicia means comprise:

first indicia and second indicia visible only in the first position of the first indicating means and indicating, respectively, that the operator is charged or the operator is discharged;

third and fourth indicia visible only at the second position of the first indicating means and indicating, respectively, that the operator is discharged or the operator is charged; and the second two-position indicating means and the second visible indicia means comprise:

fifth indicia and an aperture visible only in the switch-closed position of the output member, the fifth indicia indicating that the output member is in the switch-closed position and the aperture permitting viewing of either the second or fourth indicia; and sixth indicia and an aperture visible only in the switch-open position of the output member, the sixth indicia indicating that the output member is in the switch-open position and the aperture permitting the viewing of either the first or third indicia.

* * * * *